US008434854B1

(12) United States Patent
Rosdahl, Jr. et al.

(10) Patent No.: US 8,434,854 B1
(45) **Date of Patent: *May 7, 2013**

(54) SYSTEM FOR INK REMOVAL FROM A PRINTHEAD ASSEMBLY

(75) Inventors: Robert E. Rosdahl, Jr., Onatario, NY (US); Michael Quoc Lu, Fairport, NY (US); John R. Uchal, Webster, NY (US); Michael J. Severn, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/276,797

(22) Filed: Oct. 19, 2011

(51) Int. Cl.
*B41J 2/165* (2006.01)

(52) U.S. Cl.
USPC ..... 347/33

(58) Field of Classification Search ..... 347/33
See application file for complete search history.

(56) References Cited

U.S. PATENT DOCUMENTS 5,300,958 A * 4/1994 Burke et al. ..... 347/28
5,555,461 A * 9/1996 Ackerman ..... 347/33
5,644,345 A * 7/1997 Toniolo ..... 347/32
5,821,963 A * 10/1998 Sutera et al. ..... 347/75
6,017,110 A 1/2000 Jackson
6,033,052 A * 3/2000 Muraki ..... 347/33
6,224,186 B1 * 5/2001 Johnson et al. ..... 347/28
6,257,697 B1 * 7/2001 Kurata ..... 347/33
6,343,850 B1 * 2/2002 Domagall ..... 347/33
6,644,775 B2 11/2003 Murcia et al.
7,347,528 B2 * 3/2008 Van Gerven ..... 347/33
2002/0075349 A1 * 6/2002 Sawicki ..... 347/33
2003/0035019 A1 * 2/2003 Dietl et al. ..... 347/33
2003/0081055 A1 * 5/2003 Wotton et al. ..... 347/33
2004/0017423 A1 * 1/2004 Wotton et al. ..... 347/33
2005/0264601 A1 * 12/2005 Park ..... 347/33
2006/0023020 A1 * 2/2006 Hattori et al. ..... 347/33
2009/0102906 A1 4/2009 Phillips et al.
2010/0238227 A1 9/2010 Nystrom et al.

* cited by examiner

*Primary Examiner* — Matthew Luu
*Assistant Examiner* — Alexander D Shenderov
(74) *Attorney, Agent, or Firm* — Maginot, Moore & Beck, LLP

(57) ABSTRACT

A printhead cleaning device includes a housing having an opening and an ink receptacle positioned within the opening. A member extends from the ink receptacle and through the opening. The member is configured to contact a faceplate of a printhead to enable liquid ink emitted onto the faceplate to move from across the member into the ink receptacle.

17 Claims, 4 Drawing Sheets

SYSTEM FOR INK REMOVAL FROM A PRINTHEAD ASSEMBLY

TECHNICAL FIELD

This disclosure relates generally to imaging devices that eject ink to form ink images on print media, and, more particularly, to imaging devices that clean ink from printheads in the device.

BACKGROUND

In general, inkjet printers include at least one printhead that ejects drops of liquid ink onto recording media or an image receiving member. In an indirect or offset printer, the inkjets eject ink onto an image receiving member, such as a rotating metal drum or endless belt, before the image is transferred to print media. In a direct printer, the inkjets eject ink directly onto the media, which may be in sheet or continuous web form. A phase change inkjet printer employs phase change inks that are solid at ambient temperature, but transition to a liquid phase at an elevated temperature. Once the melted ink is ejected onto the media or image receiving member, depending upon the type of printer, the ink droplets quickly solidify to form an ink image.

Printers typically conduct various maintenance operations to ensure proper operation of the inkjets in each printhead. One known maintenance operation removes particles or other contaminants that may interfere with printing operations from each printhead in a printer. During such a cleaning maintenance operation, the printheads purge ink through some or all of the inkjets in the printhead. The purged ink flows from the apertures of the inkjets that are located in a faceplate of each printhead onto the faceplate of each printhead. The ink rolls downwardly under the effect of gravity to an ink drip bib mounted at the lower edge of the faceplate. The bib is configured with one or more multiple drip points where the liquid ink collects and drips into an ink receptacle. In some printers, one or more wipers are manipulated to contact the faceplate of each printhead and wipe the purged ink toward the drip bib to facilitate the collection and removal of the purged ink.

While existing cleaning processes are useful to maintain printheads, removing residual purged ink from the printhead remains a challenge. This challenge is particularly significant in phase change ink printers since the ink in these printers can solidify and adhere to structures in the printer. Specifically, surface tension may cause a small portion of the purged ink to remain in contact with the printhead or the drip bib after the cleaning process. The solidified ink may interfere with imaging operations if the solidified ink breaks free from the printhead faceplate or drip bib. The released solid ink may contact a web or other image receiving member as the image receiving member moves past printheads in the print zone. The solidified ink may negatively affect image quality on the image receiving member, and the image receiving member may carry the solidified ink past one or more printheads in the print zone. Since printheads are often positioned a short distance from the image receiving member, the solid ink may contact the faceplate of one or more printheads with possibly adverse consequences. Thus, improved printhead cleaning is desirable.

SUMMARY

In one embodiment, a device for cleaning a printhead has been developed. The device includes a housing having an opening, an ink receptacle within the housing that is configured to hold a volume of ink, the ink receptacle being in fluid communication with the opening in the housing, and a member having a first end and a second end. The first end of the member is positioned in fluid communication with the ink receptacle and the second end of the member extends out of the opening in the housing to a position that enables the second end of the member to contact a printhead faceplate to provide a surface for liquid ink emitted from the printhead onto the printhead faceplate to move from the printhead to the ink receptacle.

In another embodiment, a system for collecting ink into an ink receptacle has been developed. The system includes a housing having an opening, an ink receptacle within the housing that is configured to hold a volume of ink, a printhead array having a plurality of printheads, each printhead having a plurality of inkjets, a member having a first end and a second end, and a drive mechanism configured to move the printhead array between a first position and a second position. The ink receptacle is in fluid communication with the opening in the housing. Each inkjet has an aperture in a faceplate of the printhead in which the inkjet is located. The first end of the member is positioned in fluid communication with the ink receptacle and the second end of the member extends out of the opening in the housing to a position that enables the second end of the member to contact the faceplate of at least one of the plurality of printheads to provide a path for liquid ink emitted from the at least one printhead onto the faceplate of the at least one printhead to move ink from the at least one printhead faceplate to the ink receptacle. The plurality of printheads are removed from contact with the member in the first position and are placed in contact with the member in the second position.

DETAILED DESCRIPTION

Figure 1:
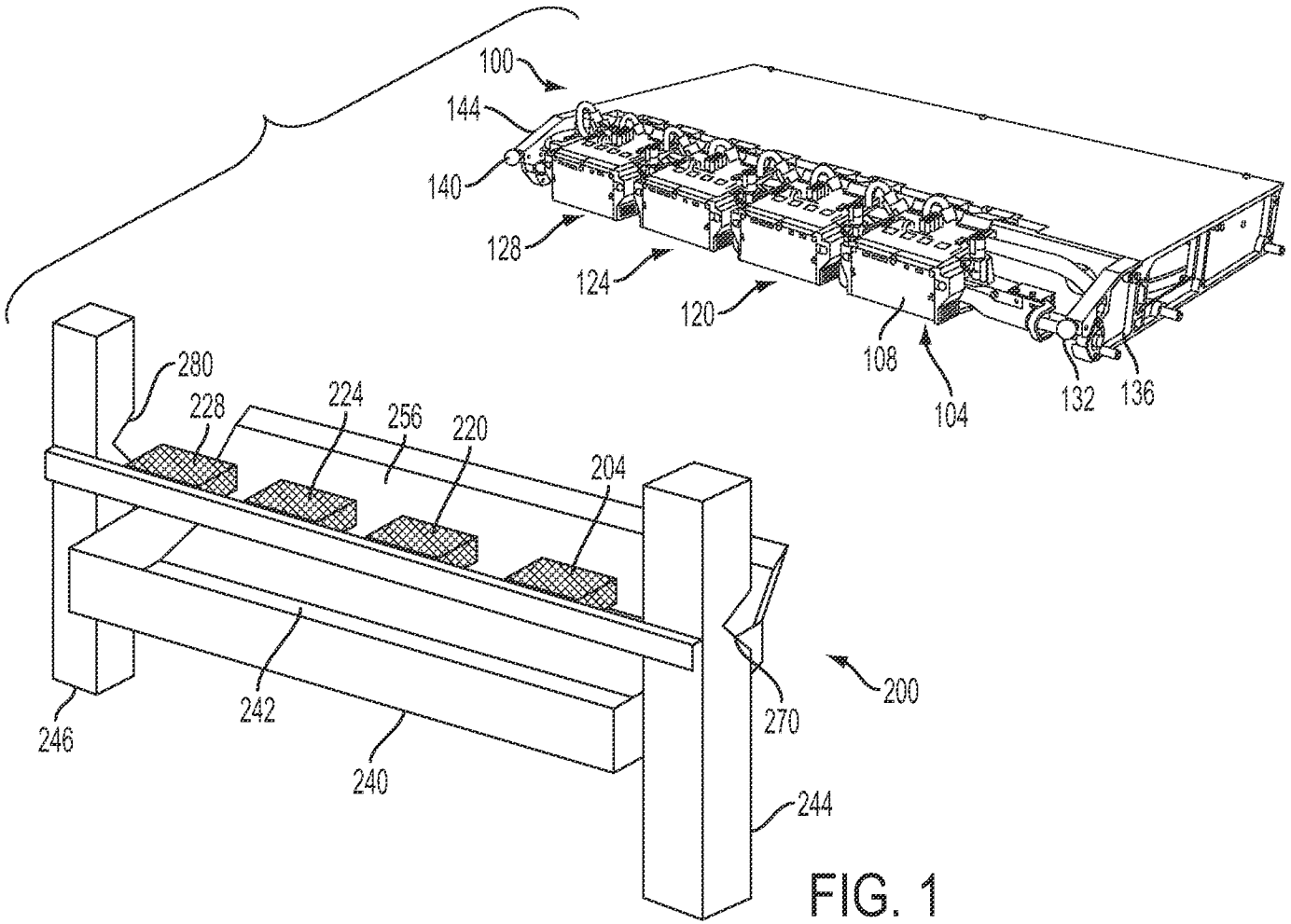
FIG. 1 is a partially exploded view of a printhead array and a cleaning unit.

For a general understanding of the present embodiments, reference is made to the drawings. In the drawings, like reference numerals have been used throughout to designate like elements. As used herein, the terms "printer" generally refer to an apparatus that applies an ink image to print media and may encompass any apparatus, such as a digital copier, bookmaking machine, facsimile machine, multi-function machine, etc. which performs a printing function for any purpose.

As used in this document, "ink" refers to a colorant that is liquid when applied to an image receiving member. For example, ink may be aqueous ink, ink emulsions, solvent based inks and phase change inks. Phase changes inks are inks that are in a solid or gelatinous state at room temperature and change to a liquid state when heated to an operating temperature for application or ejection onto an image receiving member. The phase change inks return to a solid or gelatinous state when cooled on print media after the printing process. "Print media" can be a physical sheet of paper, plastic, or other suitable physical substrate suitable for receiving ink images, whether precut or web fed.

As used herein, the term "direct printer" refers to a printer that ejects ink drops directly onto a print medium to form the ink images. As used herein, the term "indirect printer" refers to a printer having an intermediate image receiving member, such as a rotating drum or endless belt, which receives ink drops that form an ink image. In the indirect printer, the ink image is transferred from the indirect member to a print medium via a "transfix" operation that is well known in the art. A printer may include a variety of other components, such as finishers, paper feeders, and the like, and may be embodied as a copier, printer, or a multifunction machine. Image data corresponding to an ink image generally may include information in electronic form, which is to be rendered on print media by a marking engine and may include text, graphics, pictures, and the like.

The term "printhead" as used herein refers to a component in the printer that is configured to eject ink drops onto the image receiving member. A typical printhead includes a plurality of inkjets that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member.

FIG. 1 depicts a printhead array 100 and a cleaning unit 200. Printhead array 100 includes printhead units 104, 120, 124, and 128, docking balls 132 and 140, and printhead array carriage members 136 and 144. Each printhead unit includes a printhead face, with printhead unit 104 shown having a front faceplate 108. The printhead faceplate 108 includes an array of apertures to which inkjets are fluidly coupled for the ejection of ink drops onto an image receiving surface. A printer may include one or more printhead arrays, such as printhead array 100, that are configured to eject ink having one or more colors onto the image receiving surface.

Cleaning unit 200 includes a housing, shown here as support rails 244 and 246 and ink receptacle 240, an ink collecting member 256, and printhead wiper units 204, 220, 224, and 228. Support rails 244 and 246 maintain ink receptacle 240 in place and support the wiper units 204, 220, 224, and 228. Ink receptacle 240 is a container that forms a volume with a sufficient size to hold ink purged from each of the printheads 104, 120, 124, and 128 in printhead array 104 during cleaning operations. The top 242 of the ink receptacle 240 is open to enable ink purged from printheads in the printhead array 100 to flow into the ink receptacle 240. While cleaning unit 200 includes a single ink receptacle 240, alternative cleaning unit embodiments may employ two or more receptacles. Rails 244 and 246 include docking members 270 and 280, respectively. The docking members 270 and 280 are configured to engage docking balls 132 and 140, respectively, on the printhead array 100 to secure the printhead array 100 to the cleaning unit 200 during purge and cleaning operations.

In the embodiment of FIG. 1, the printhead array 100 is configured to engage the cleaning unit 200 for cleaning operations. Carriage members 136 and 144 guide the printhead array 100 to the cleaning unit 200, where docking balls 132 and 140 engage docking members 270 and 280, respectively Each docking ball is configured to slide into a fully engaged position with the corresponding docking member in the cleaning unit. Wiper units 204, 220, 224, and 228 are secured to the support rails 244 and 246 and are positioned to wipe the faces of printheads 104, 120, 124, and 128, respectively, when the printhead array 100 is engaged to the cleaning unit 200. Typical docking members include triangular or conically shaped indentations formed in support members that are arranged along either side of an ink receptacle or an image receiving surface. While support rails 244 and 246 and ink receptacle 240 form the housing for the cleaning unit 200, the housing may be any suitable structure that secures the cleaning unit components and enables the cleaning unit to engage with a printhead array for cleaning operations.

The ink receptacle 240 is configured to receive ink from printhead array 100 through the open top 242. The ink collecting member 256 extends through the housing opening 242 to enable the ink collecting member 256 to contact the printhead array 100. The ink collecting member 256 has a width that is sufficient to enable the face of each of the printhead units 104, 120, 124, and 128 to contact the ink collecting member 256 as the printhead array 100 engages and disengages with the cleaning unit 200. The ink collecting member 256 of the illustrated embodiment is a rectangular plate, although any shape and size capable of capturing ink purged from the printheads may be used. The ink collecting member 256 can be formed of stainless steel or any other material suitable to direct ink from a printhead to an ink receptacle.

Figure 2:
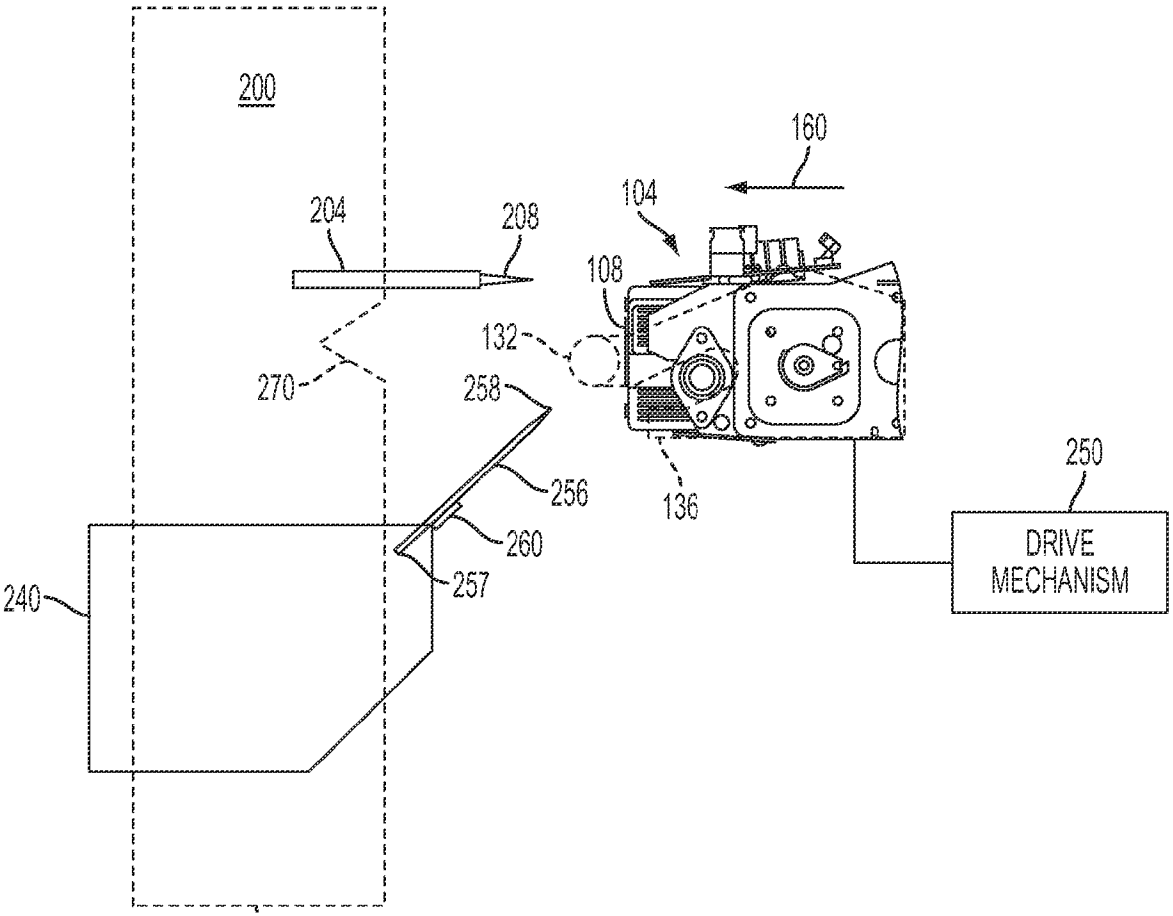
FIG. 2 is a side view of a printhead disengaged from a cleaning unit.

FIG. 2 depicts a side view of a printhead unit 104 in a position prior to engaging the printhead unit 104 with the cleaning unit 200 and ink receptacle 240 for printhead cleaning. The ink receptacle 240 includes the ink collecting member 256 and a heater 260. The heater 260 is an electrical heater mounted to the member 256 to heat the member during printhead cleaning operations. The heater 260 heats the ink collecting member 256 to a temperature that enables phase-change ink emitted from the printhead 104 to remain in a liquid state and flow into the ink receptacle 240. The cleaning unit 200 includes a docking member 270 in the housing guide rail 244 positioned on one side of ink receptacle 240, as well as a wiper 204, which includes a wiper blade 208. Printhead unit 104 includes a printhead face 108 and is shown held in position by a carriage member 136. Printhead unit 104 may be one printhead in an array of printheads as depicted in FIG. 1. Carriage member 136 and docking ball 132 are configured to guide printhead unit 104 to engage with docking member 270.

In the configuration of FIG. 2, a drive mechanism 250 is operatively connected to the carriage member 136, docking ball 132, and printhead unit 104. Typical embodiments for drive mechanism 250 include electric motors coupled to the printhead array using gears or pulleys, hydraulic and pneumatic actuators, or any other mechanism configured to reposition printheads in the printer. The drive mechanism 250 moves the docking ball 132, carriage 136, and printhead unit 104 towards the ink receptacle 240 in direction 160 until the docking ball 132 couples with the docking member 270 and the ink collecting member 256 engages the printhead faceplate 108.

Figure 3:
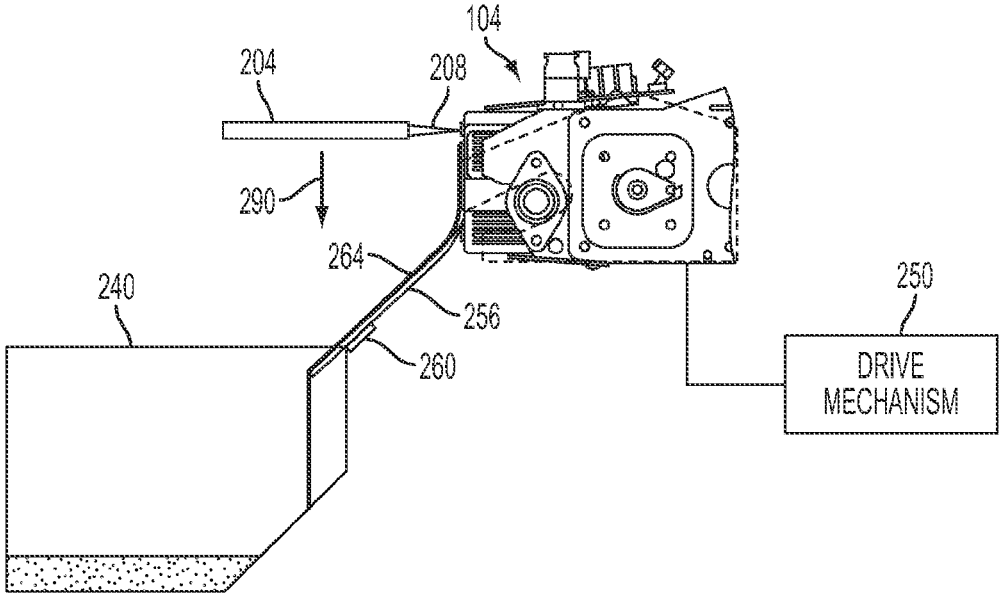
FIG. 3 is a side view of a printhead engaged to a cleaning unit.

The ink collecting member 256 has a first end 257 and a second end 258. The first end 257 is located at a position inside the ink receptacle 240 that enables gravity to pull ink from the second end 258 of the ink collecting member 256 into the ink receptacle 240. The second end 258 of the ink collecting member 256 is configured to engage the printhead faceplate 108 during cleaning and maintenance in order to collect ink emitted from the apertures onto the faceplate during a purge process. The second end 258 of the ink collecting member 256 may be tapered to facilitate a sealing relationship between the member 256 and the faceplate 108. This seal helps ensure the ink flows from the printhead faceplate 108 across the ink collecting member 256 to the receptacle and helps prevent ink from sliding past the interface of the second member and the faceplate and reaching the drip bib. FIG. 3 shows the faceplate of the printhead 104 engaged with the ink collecting member 256 and wiper blade 208 during a purge process. When the ink collecting member 256 comes into contact with the faceplate of the printhead 104, the ink collecting member 256 flexes. Deformation of the ink collecting member 256 helps the second end of the ink collecting member to form a seal with the faceplate of the printhead 104. The flexure of the ink collecting member 256 also aids in the draining of the ink from the faceplate into the receptacle 240.

The flexibility of the ink collecting member 256 cannot compromise the ability of the member to resist being moved by the action of the wiper. Consequently, the thickness of the member must enable the member 256 to flex while still providing sufficient resistance to the wiper movement. Still, if the rigidity of the member 256 is too stiff, the member may transfer too much energy to the faceplate 108 when the receptacle and faceplate are moved into contact with the faceplate. Too much energy may disturb the positioning of the printhead and the registration of the printhead with the other printheads in the printer. These competing requirements of the ink collecting member 256 must be balanced against one another. Thus, the thickness of the member 256 depends upon the material used to form the member. In one embodiment, stainless steel is used and the thickness of the stainless sheet is a range of 0.05 mm to 0.30 mm units, although other ranges and materials may be used depending upon the printheads, the mounting of the printheads, and the susceptibility of the printheads to contact. In phase change inkjet printers, the material used for the member 256 must also be thermally conductive to enable the heating of the member to a temperature that enables melted ink to remain melted.

Figure 4:
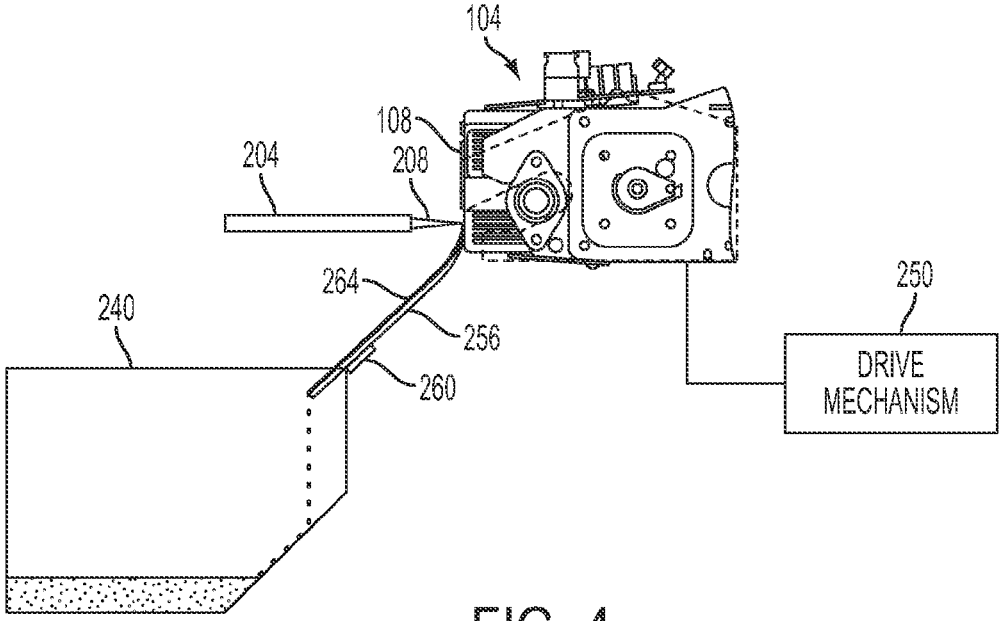
FIG. 4 is a side view of a printhead engaged to a cleaning unit.
Figure 5:
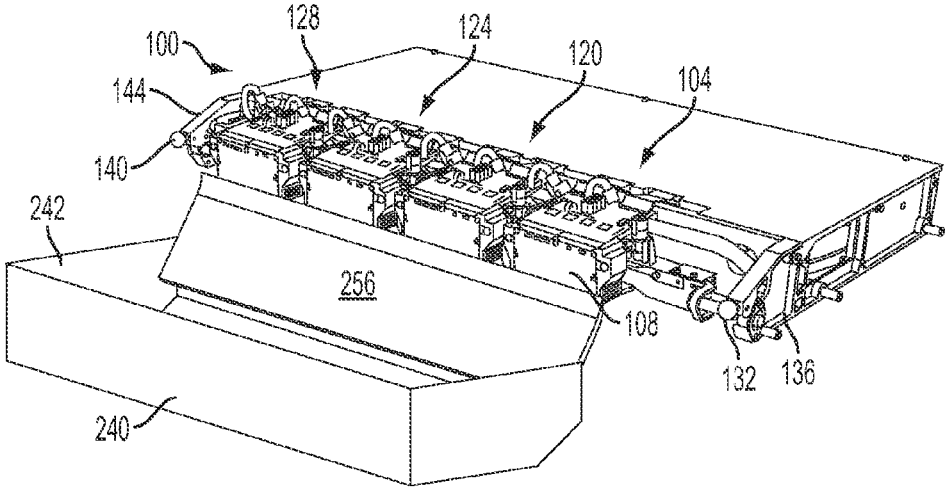
FIG. 5 is a perspective view of a printhead array engaged to a cleaning unit, with the housing and wipers removed for clarity.

During purge operations, the receptacle 240 is positioned close enough to the faceplate 108 to enable the second end 258 of the member 256 to contact the faceplate 108 at a position below the apertures in the faceplate, but above the drip bib/faceplate juncture. Pressure applied to the reservoir within the printhead urges ink 264 through the inkjets to the apertures in the faceplate 108. This pressure does not eject the ink, but rather releases ink onto the faceplate 108. This action helps unclog the inkjets, dissolve debris or solidified ink on the faceplate, and act as a lubricant for the wiper. Once the purged ink 264 flows down the printhead face 108 to the juncture with the second end 258 of the ink collecting member 256, the ink collecting member 256 guides the ink 264 into the ink receptacle 240. Wiper 204 and wiper blade 208 are also moved into contact with the faceplate 108 above the apertures for the inkjets and swiped downwardly in direction 290 to direct any ink 264 remaining on the printhead face 108 onto the ink collecting member 256 and into the ink receptacle 240. FIG. 4 shows the printhead 104 engaged with the ink collecting member 256 and wiper blade 208 at the end of a wiping operation. The wiper 204 and wiper blade 208 are shown at the junction of the second end 258 of the member 256 with the bottom part of the printhead face 108. The wiper blade 208 is in contact with the second end 258 of the ink collecting member 256 to help ensure that the ink 264 has been removed from the faceplate 108 and directed onto the ink collecting member 256 for collection in the receptacle 240. FIG. 5 shows the printhead array 100, with printheads 104, 120, 124, and 128 engaged to the ink collecting member 256. The housing and wiper units have been removed for clarity to show the ink collecting member 256.

Figure 6:
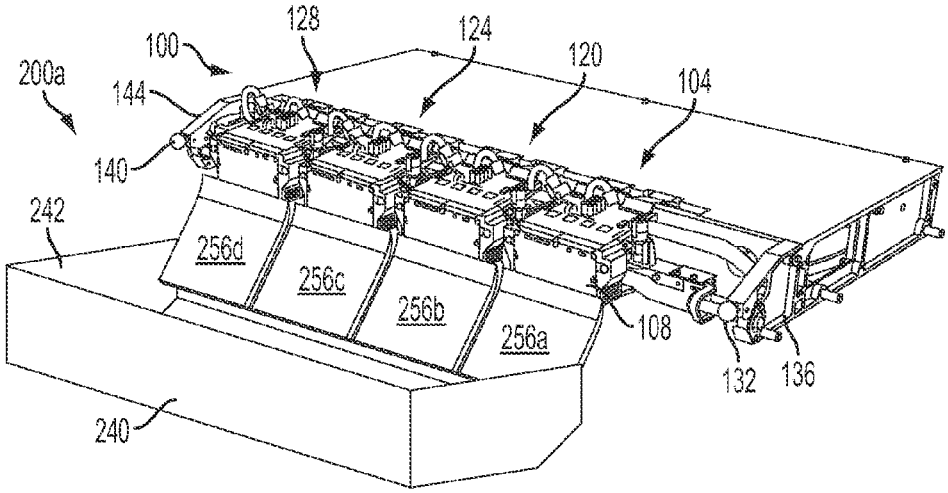
FIG. 6 is a perspective view of a printhead array engaged to a cleaning unit of an alternate embodiment, with the housing and wipers removed for clarity.

FIG. 6 shows an alternate configuration of cleaning unit 200*a*. The cleaning unit 200*a* contains a housing and wiper units similar to the embodiment of FIG. 1. Instead of a single ink collecting member, however, the cleaning unit 200*a* includes four ink collecting members 256*a*, 256*b*, 256*c*, and 256*d*. Each ink collecting member is substantially equal in size. The ink collecting members 256*a*, 256*b*, 256*c*, and 256*d* are configured to engage printheads 104, 120, 124, and 128, respectively, of printhead array 100. The ink collecting members 256*a*, 256*b*, 256*c*, and 256*d* are positioned in a coplanar configuration, although they may be arranged in different planes, for example, to engage printheads that are arranged in a staggered array. Each of the ink collecting members 256*a*, 256*b*, 256*c*, and 256*d* flexes when engaging a corresponding one of the printheads 104, 120, 124, and 128 as shown in FIG. 6. The ink collecting members 256*a*, 256*b*, 256*c*, and 256*d* may be formed of any material, such as stainless steel, suitable to allow ink flow from a printhead to an ink receptacle, and each ink collecting member is wide enough to collect all the ink purged from a single printhead.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

We claim:

1. A printhead cleaning device for use in an inkjet printer comprising:

a housing having an opening;

an ink receptacle within the housing that is configured to hold a volume of ink, the ink receptacle being in fluid communication with the opening in the housing;

a member having a first end and a second end, the first end of the member being positioned in fluid communication with the ink receptacle and the second end of the member extending out of the opening in the housing to a position that enables the second end of the member to contact a printhead faceplate to provide a surface for liquid ink emitted from the printhead onto the printhead faceplate to move from the printhead to the ink receptacle;

a wiper, the wiper being configured to contact the printhead faceplate at a first location that is above a plurality of inkjets formed in the printhead and to maintain contact with the printhead faceplate while moving to a second location on the printhead faceplate at which the second end of the member contacts the printhead faceplate to enable the wiper to urge ink from the printhead faceplate onto the member.

2. The printhead cleaning device of claim 1 wherein the member has a width that enables the member to receive ink emitted from a plurality of inkjets formed in the printhead.

3. The printhead cleaning device of claim 1, wherein the member is configured to contact a faceplate of each printhead in a plurality of printheads to provide a path for liquid ink emitted onto each printhead faceplate in the plurality of printheads to move ink from each printhead faceplate to the ink receptacle.

4. The printhead cleaning device of claim 1 further comprising:

a heater mounted to the member and configured to heat the member to a predetermined temperature to enable phase change ink to remain in a liquid state and move from the printhead faceplate to the ink receptacle.

5. The printhead cleaning device of claim 1, the second end of the member further comprising:

a tapered edge.

6. The printhead cleaning device of claim 1 wherein the second end of the member is further configured to contact the printhead faceplate at a location below a plurality of inkjets formed in the printhead and positioned at an angle that enables gravity to urge ink emitted from the plurality of inkjets toward the ink receptacle.

7. The printhead cleaning device of claim 1 wherein the member is further configured to flex in response to the second end of the member contacting the printhead faceplate.

8. The printhead cleaning device of claim 1 wherein the member is substantially comprised of stainless steel.

9. The printhead cleaning device of claim 1 wherein the receptacle and the opening having a width that corresponds to a width of a plurality of printheads.

10. The printhead cleaning device of claim 1 further comprising:

a plurality of members, each member having a first end and a second end, the first end of each member being positioned in fluid communication with the ink receptacle and the second end of each member extending out of the opening in the housing to a position that enables the second end of the member to contact at least one printhead faceplate in a plurality of printheads to provide a path for liquid ink emitted from the at least one printhead onto the at least one printhead faceplate to move ink from the at least one printhead faceplate to the ink receptacle.

11. A system for collecting ink into an ink receptacle, comprising:

a housing having an opening;

an ink receptacle within the housing that is configured to hold a volume of ink, the ink receptacle being in fluid communication with the opening in the housing;

a printhead array having a plurality of printheads, each printhead having a plurality of inkjets, each inkjet having an aperture in a faceplate of the printhead in which the inkjet is located;

a member having a first end and a second end, the first end of the member being positioned in fluid communication with the ink receptacle and the second end of the member extending out of the opening in the housing to a position that enables the second end of the member to contact the faceplate of at least one of the plurality of printheads to provide a path for liquid ink emitted from the at least one printhead onto the faceplate of the at least one printhead to move ink from the at least one printhead faceplate to the ink receptacle;

a drive mechanism configured to move the printhead array between a first position and a second position, the plurality of printheads being removed from contact with the member in the first position and being placed in contact with the member in the second position; and a wiper, the wiper being configured to contact the faceplate of one printhead in the plurality of printheads at a first location that is above a plurality of inkjets formed in the one printhead in the plurality of printheads and to maintain contact with the one printhead faceplate while moving to a second location on the one printhead faceplate at which the second end of the member contacts the one printhead faceplate, the movement of the wiper urging ink from the one printhead faceplate onto the member.

12. The system of claim 11, the member further comprising:

a heater mounted to the member and configured to heat the member to a predetermined temperature that enables melted phase change ink to remain in a liquid phase and move from the at least one printhead faceplate to the ink receptacle.

13. The system of claim 11, the second end of the member further comprising:

a tapered edge.

14. The system of claim 11 further comprising:

a plurality of members, each member having a first end and a second end, the first end of each member being positioned in fluid communication with the ink receptacle and the second end of each member extending out of the opening in the housing to a position that enables the second end of each member to contact the faceplate of at least one printhead in the plurality of printheads to provide a path for liquid ink to move from the at least one printhead faceplate to the ink receptacle.

15. The system of claim 11 wherein the second end of the member is configured to contact the faceplate of at least one printhead at a location below the plurality of inkjets in the at least one printhead and positioned at an angle that enables gravity to urge ink emitted from the plurality of inkjets onto the faceplate of the at least one printhead toward the ink receptacle.

16. The system of claim 11 wherein the member is further configured to flex in response to contact between the second end of the member and the at least one printhead faceplate.

17. The system of claim 11 wherein the member is substantially comprised of stainless steel.

* * * * *